US011562700B2

(12) United States Patent
Lee et al.

(10) Patent No.: US 11,562,700 B2
(45) Date of Patent: Jan. 24, 2023

(54) DISPLAY DEVICE AND DRIVING METHOD THEREOF

(71) Applicant: LG Display Co., Ltd., Seoul (KR)

(72) Inventors: Sunho Lee, Daegu (KR); SangJun Lee, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/489,604

(22) Filed: Sep. 29, 2021

(65) Prior Publication Data

US 2022/0172683 A1 Jun. 2, 2022

(30) Foreign Application Priority Data

Nov. 27, 2020 (KR) ..... 10-2020-0162855

(51) Int. Cl.
*G09G 3/3291* (2016.01)
*G09G 3/3233* (2016.01)
*G09G 3/3266* (2016.01)

(52) U.S. Cl.
CPC ..... *G09G 3/3291* (2013.01); *G09G 3/3233* (2013.01); *G09G 3/3266* (2013.01); *G09G 2310/0289* (2013.01); *G09G 2310/08* (2013.01)

(58) Field of Classification Search
CPC .. G09G 3/3291; G09G 3/3266; G09G 3/3233; G09G 2310/08; G09G 2310/0289
See application file for complete search history.

(56) References Cited

U.S. PATENT DOCUMENTS

2016/0372039 A1* 12/2016 Chung ..... G09G 3/3233
2020/0082762 A1* 3/2020 Takasugi ..... G09G 3/3266

* cited by examiner

*Primary Examiner* — Kenneth B Lee, Jr.
(74) *Attorney, Agent, or Firm* — Fenwick & West LLP

(57) ABSTRACT

Embodiments of the present disclosure relate to a display device comprising a display panel on which a plurality of gate lines, a plurality of data lines, a plurality of reference voltage lines, and a plurality of subpixels are disposed, a gate driving circuit providing scan signals to the plurality of gate lines, a data driving circuit providing data voltages to the plurality of data lines, and including at least one reference voltage switch for controlling reference voltages supplied to the plurality of reference voltage lines, and a timing controller controlling the gate driving circuit and the data driving circuit, and maintaining the reference voltage of the reference voltage line at a level of turning off a light emitting element while at least one scan transistor disposed on the plurality of subpixels is turned off before a sensing process for sensing a characteristic value of the plurality of subpixels is performed.

12 Claims, 15 Drawing Sheets

DISPLAY DEVICE AND DRIVING METHOD THEREOF

CROSS REFERENCE TO RELATED APPLICATION

This application claims priority from Republic of Korea Patent Application No. 10-2020-0162855, filed on Nov. 27, 2020, which is hereby incorporated by reference in its entirety.

BACKGROUND

Field

Embodiments of the present disclosure relate to a display device and a driving method for improving image quality by diminishing a coupling effect in a driving process.

Description of Related Art

With the development of the information society, there has been an increasing demand for a variety of types of image display devices. In this regard, a range of display devices, such as liquid crystal display device, and electroluminescence display device, have recently come into widespread use.

Among such display devices, the electroluminescence display devices have superior properties, such as rapid response speeds, high contrast ratios, high emissive efficiency, high luminance, and wide viewing angles, since self-emissive light emitting diodes are used as a light emitting element. In this case, the light emitting diode may be implemented with an inorganic material or an organic material.

Such an electroluminescence display device may include light emitting diodes disposed in a plurality of subpixels aligned in a display panel, and may control the light emitting diodes to emit light by controlling a voltage flowing through the light emitting diodes, so as to display an image while controlling luminance of the subpixels.

In such an electroluminescence display device, the light emitting diode and a driving transistor to drive the light emitting diode are disposed in each subpixel defined in the display panel. At this time, there may be deviations in the characteristics of transistors in each subpixel such as threshold voltage or mobility, due to variations over the driving time or different driving times among the subpixels. As a result, luminance deviation (luminance non-uniformity) between subpixels may occur, and image quality may be degraded.

Accordingly, a technology for sensing and compensating a characteristic value of a driving transistor such as a threshold voltage or mobility in the electroluminescence display device has been used in order to solve the luminance deviation between subpixels.

However, there are problems that a reference voltage line transitions to an unstable state, and the light emitting element emits light abnormally in a preparation process for sensing the characteristic value of the driving transistor.

In this case, the characteristic value of the driving transistor in the display panel may vary depending on a used environment of the display device. In particular, since the characteristic values of the driving transistors may be variously changed according to environmental factors such as the usage time and temperature variation of the display device, it is difficult to sense and compensate the characteristic values of the driving transistors in consideration of these environmental factors.

SUMMARY

Accordingly, a display device and a driving method are disclosed that are capable of reducing a phenomenon in which the light emitting element emits light abnormally in a preparation process for sensing the characteristic values of the display device.

In particular, a display device and a driving method are disclosed that are capable of improving image quality by stably maintaining a reference voltage in a preparation process for sensing the characteristic values of the display device.

The problems to be described below according to the embodiments of the present disclosure are not limited to the problems mentioned above, and other problems that are not mentioned will be clearly understood by those skilled in the art from the following description.

A display device according to an embodiment of present disclosure includes a display panel on which a plurality of gate lines, a plurality of data lines, a plurality of reference voltage lines, and a plurality of subpixels are disposed; a gate driving circuit providing scan signals to the plurality of gate lines; a data driving circuit providing data voltages to the plurality of data lines, and including at least one reference voltage switch for controlling reference voltages supplied to the plurality of reference voltage lines; and a timing controller controlling the gate driving circuit and the data driving circuit, and maintaining the reference voltage of the reference voltage line at a level of turning off a light emitting element while at least one scan transistor disposed on the plurality of subpixels is turned off before a sensing process for sensing a characteristic value of the plurality of subpixels is performed.

In the display device according to an embodiment of present disclosure, the plurality of subpixels may include a driving transistor providing current to the light emitting element, a first scan transistor electrically connected between a gate node of the driving transistor and the data line, a second scan transistor electrically connected between a source node or a drain node of the driving transistor and the reference voltage line, and a storage capacitor electrically connected between a gate node and a source node or a drain node of the first scan transistor.

In the display device according to an embodiment of present disclosure, the plurality of subpixels may include: a driving transistor providing current to the light emitting element; a first scan transistor in which a gate node is connected to a first gate line, a drain node is connected to the data line, and a source node is connected to a gate node of the driving transistor; a second scan transistor in which a gate node is connected to a second gate line, a drain node is connected to the reference voltage line, and a source node is connected to a source node of the driving transistor; a third scan transistor in which a gate node is connected to a light emitting line, a drain node is connected to a driving voltage line, and a source node is connected to a drain node of the driving transistor; a storage capacitor connected between a gate node and a source node of the driving transistor; and an auxiliary capacitor connected between the driving voltage line and the source node of the driving transistor.

In the display device according to an embodiment of present disclosure, the plurality of subpixels may include: a driving transistor providing current to the light emitting element; a first scan transistor transmitting the data voltage supplied through the data line in response to a first scan signal; a second scan transistor suppling the reference voltage to an anode electrode of the light emitting element in response to a second scan signal; a third scan transistor connecting a gate node and a source node of the driving transistor in response to the first scan signal; a fourth scan transistor suppling the reference voltage to a first node to which the first scan transistor and a storage capacitor are connected in response to a light emission control signal; a fifth scan transistor controlling a driving current flowing to an anode electrode of the light emitting element in response to the light emission control signal; the storage capacitor connected between the driving transistor and the first scan transistor; and an auxiliary capacitor connected between the driving voltage line and the anode electrode of the light emitting element.

In the display device according to an embodiment of present disclosure, the plurality of subpixels may include: a driving transistor providing current to the light emitting element; a first scan transistor connected between a gate node and a drain node of the driving transistor; a second scan transistor connected between the data line and a source node of the driving transistor; a third scan transistor connected between a driving voltage line and a source node of the driving transistor; a fourth scan transistor connected between a drain node of the driving transistor and an anode electrode of the light emitting element; a fifth scan transistor connected between a gate node of the driving transistor and the reference voltage line; a sixth scan transistor connected between the reference voltage line and the anode electrode of the light emitting element; and a storage capacitor connected between the driving voltage line and the fifth scan transistor.

In the display device according to an embodiment of present disclosure, the data driving circuit may include: a first reference voltage switch connected to one reference voltage line of the plurality of reference voltage lines; and a second reference voltage switch connected in parallel with the first reference voltage switch through the one reference voltage line.

The display device according to an embodiment of present disclosure may further include a logic circuit receiving a second control signal and a third control signal from the timing controller; and a level shifter receiving a first control signal from the timing controller and an output signal of the logic circuit, and generating a first control signal-for-reference voltage switch and a second control signal-for-reference voltage switch for controlling the first reference voltage switch and the second reference voltage switch.

In the display device according to an embodiment of present disclosure, the characteristic value of the plurality of subpixels may be a threshold voltage or a mobility of the driving transistor.

In the display device according to an embodiment of present disclosure, the sensing process may include at least one of: an on-sensing process in which the characteristic value is sensed during a parameter loading process after a power-on signal is generated; an off-sensing process in which the characteristic value is sensed while the data voltage is cut off after a power-off signal is generated; and a real-time sensing process in which the characteristic value is sensed for each blank period during a display driving period.

A driving method of a display device including a display panel on which a plurality of gate lines, a plurality of data lines, a plurality of reference voltage lines, and a plurality of subpixels are disposed, a gate driving circuit providing scan signals to the plurality of gate lines, and a data driving circuit providing data voltages to the plurality of data lines, and including at least one reference voltage switch for controlling reference voltages supplied to the plurality of reference voltage lines, includes changing a scan transistor to a turn-off state before performing a sensing process of a characteristic value; maintaining the reference voltage line in a turn-on state for a predetermined time while the scan transistor is turned off; supplying the reference voltage of a level to turn off a light emitting element while the reference voltage line is turned on; and changing the reference voltage line to a turn-off state when the predetermined time elapses.

The data driving circuit may include a first reference voltage switch connected to one reference voltage line of the plurality of reference voltage lines, and a second reference voltage switch connected in parallel with the first reference voltage switch through the one reference voltage line, and a logic circuit receiving a second control signal and a third control signal from the timing controller, and a level shifter receiving a first control signal and an output signal of the logic circuit to which a second control signal and a third control signal are supplied, and generating a first control signal-for-reference voltage switch and a second control signal-for-reference voltage switch and a second reference voltage switch.

The sensing process may include at least one of an on-sensing process in which the characteristic value is sensed during a parameter loading process after a power-on signal is generated, an off-sensing process in which the characteristic value is sensed while the data voltage is cut off after a power-off signal is generated, and a real-time sensing process in which the characteristic value is sensed for each blank period during a display driving period.

According to embodiments of the present disclosure, it is possible to provide a display device and a driving method thereof capable of reducing a phenomenon in which the light emitting element emits abnormally in a preparation process for sensing the characteristic values of the display device.

In addition, according to embodiments of the present disclosure, it is possible to provide a display device and a driving method thereof capable of improving image quality by stably maintaining a reference voltage in a preparation process for sensing the characteristic values of the display device.

The effects of the embodiments disclosed in the present disclosure are not limited to the above mentioned effects. In addition, the embodiments disclosed in the present disclosure may cause another effect not mentioned above, which will be clearly understood by those skilled in the art from the following description.

DETAILED DESCRIPTION

Figure 1:
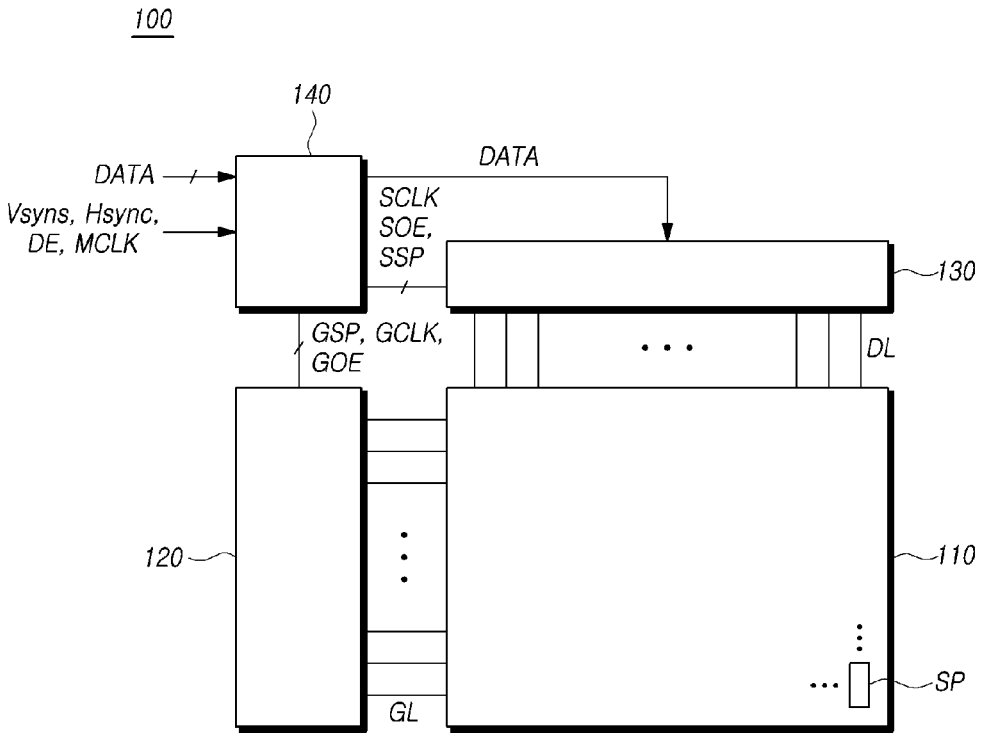
FIG. 1 illustrates a schematic diagram of a display device according to embodiments of the present disclosure.

The advantages and features of the present disclosure and methods of the realization thereof will be apparent with reference to the accompanying drawings and detailed descriptions of the embodiments. The present disclosure should not be construed as being limited to the embodiments set forth herein and may be embodied in a variety of different forms. Rather, these embodiments are provided so that the present disclosure will be thorough and complete, and will fully convey the scope of the present disclosure to those having ordinary knowledge in the technical field. The scope of the present disclosure shall be defined by the appended claims.

The shapes, sizes, ratios, angles, numbers, and the like, inscribed in the drawings to illustrate exemplary embodiments are illustrative only, and the present disclosure is not limited to the embodiments illustrated in the drawings. Throughout this document, the same reference numerals and symbols will be used to designate the same or like components. In the following description of the present disclosure, detailed descriptions of known functions and components incorporated into the present disclosure will be omitted in the situation in which the subject matter of the present disclosure may be rendered unclear thereby. It will be understood that the terms "comprise", "include", "have", and any variations thereof used herein are intended to cover non-exclusive inclusions unless explicitly described to the contrary. Descriptions of components in the singular form used herein are intended to include descriptions of components in the plural form, unless explicitly described to the contrary.

In the analysis of a component, it shall be understood that an error range is included therein, even in the situation in which there is no explicit description thereof.

When spatially relative terms, such as "on", "above", "under", "below", and "on a side of", are used herein for descriptions of relationships between one element or component and another element or component, one or more intervening elements or components may be present between the one and other elements or components, unless a term, such as "directly", is used.

When temporally relative terms, such as "after", "subsequent", "following", and "before" are used to define a temporal relationship, a non-continuous case may be included unless the term "immediately" or "directly" is used.

In descriptions of signal transmission, such as "a signal is sent from node A to node B", a signal may be sent from node A to node B via another node unless the term "immediately" or "directly" is used.

In addition, terms, such as "first" and "second" may be used herein to describe a variety of components. It should be understood, however, that these components are not limited by these terms. These terms are merely used to discriminate one element or component from other elements or components. Thus, a first component referred to as first hereinafter may be a second component within the spirit of the present disclosure.

The features of exemplary embodiments of the present disclosure may be partially or entirely coupled or combined with each other and may work in concert with each other or may operate in a variety of technical methods. In addition, respective exemplary embodiments may be carried out independently or may be associated with and carried out in concert with other embodiments.

Hereinafter, a variety of embodiments will be described in detail with reference to the accompanying drawings.

FIG. 1 illustrates a schematic diagram of a display device according to embodiments of the present disclosure.

Referring to FIG. 1, the display device 100 according to embodiments of the present disclosure may include a display panel 110 connected to a plurality of gate lines GL and a plurality of data lines DL in which a plurality of subpixels SP are arranged in rows and columns, a gate driving circuit 120 for supplying scan signals to the plurality of gate lines GL and a data driving circuit 130 for supplying data voltages to the plurality of data lines DL, and a timing controller 140 for controlling the gate driving circuit 120 and the data driving circuit 130.

The display panel 110 displays an image based on the scan signals supplied from the gate driving circuit 120 through the plurality of gate lines GL and the data voltages supplied from the data driving circuit 130 through the plurality of data lines DL.

In the case of a liquid crystal display, the display panel 110 includes a liquid crystal layer formed between two substrates, and TN (twisted nematic) mode, VA (vertical alignment) mode, IPS (in plane switching) mode, FFS (fringe field switching) mode may be operated in any known mode. In the case of an electroluminescence display device, the display panel 110 may be implemented in a top emission method, a bottom emission method, or a dual emission method.

In the display panel 110, a plurality of pixels may be disposed in a matrix form. Each pixel may be composed of subpixels SP of different colors, for example, a white subpixel, a red subpixel, a green subpixel, and a blue subpixel. Each subpixel SP may be defined by the plurality of the data lines DL and the plurality of the gate lines GL.

A subpixel SP may include a thin film transistor (TFT) arranged in a region where a data line DL and a gate line GL intersect, a light emitting element such as an light emitting diode which is emitted according to the data voltage, and a storage capacitor for maintaining the data voltage by being electrically connected to the light emitting element.

For example, when the display device 100 having a resolution of 2,160×3,840 includes four subpixels SP of white W, red R, green G, and blue B, 3,840×4=15,360 data lines DL may be provided by 2,160 gate lines GL and 3,840 data lines DL respectively connected to 4 subpixels WRGB. Each of the plurality of subpixels SP may be disposed in areas in which the plurality of gate lines GL overlap the plurality of data lines DL.

The gate driving circuit 120 is controlled by the timing controller 140, and controls the driving timing of the plurality of subpixels SP by sequentially supplying the scan signals to the plurality of gate lines GL disposed in the display panel 110.

In the display device 100 having a resolution of 2,160×3,840, an operation of sequentially supplying the scan signals to the 2,160 gate lines GL from the first gate line GL1 to the 2,160th gate line GL2160 may be referred to as 2,160-phase driving operation. Otherwise, an operation of sequentially supplying the scan signals to every four gate lines GL, as in a case in which the scan signals are supplied sequentially from first gate line GL1 to fourth gate lines GL4, and then are supplied sequentially from fifth gate line GL5 to eighth gate line GL8, may be referred to as 4-phase driving operation. As described above, an operation in which the scan signals are supplied sequentially to every N number of gate lines may be referred as N-phase driving operation.

The gate driving circuit 120 may include one or more gate driving integrated circuits (GDIC), which may be disposed on one side or both sides of the display panel 110 depending on the driving method. Alternatively, the gate driving circuit 120 may be implemented in a gate-in-panel (GIP) structure embedded in a bezel area of the display panel 110.

The data driving circuit 130 receives digital image data DATA from the timing controller 140, and converts the received digital image data DATA into an analog data voltage. Then, the data driving circuit 130 supplies the analog data voltage to each of the data lines DL at time which the scan signal is supplied through the gate line GL, so that each of the subpixels SP connected to the data lines DL emits light with a corresponding luminance in response to the analog data voltage.

Likewise, the data driving circuit 130 may include one or more source driving integrated circuits (SDIC). Each of the source driving integrated circuits SDIC may be connected to a bonding pad of the display panel 110 by a tape automated bonding (TAB) or a chip on glass (COG), or may be directly mounted on the display panel 110.

In some cases, each of the source driving integrated circuits (SDIC) may be integrated with the display panel 110. In addition, each of the source driving integrated circuits (SDIC) may be implemented with a chip on film (COF) structure. In this case, the source driving integrated circuit SDIC may be mounted on circuit film to be electrically connected to the data lines DL in the display panel 110 via the circuit film.

The timing controller 140 supplies various control signals to the gate driving circuit 120 and the data driving circuit 130, and controls the operations of the gate driving circuit 120 and the data driving circuit 130. That is, the timing controller 140 controls the gate driving circuit 120 to supply the scan signals in response to a time realized by respective frames, and on the other hand, transmits the digital image data DATA from an external source to the data driving circuit 130.

Here, the timing controller 140 receives various timing signals, including a vertical synchronization signal Vsync, a horizontal synchronization signal Hsync, a data enable signal DE, and a main clock MCLK, from an external source (e.g., a host system). Accordingly, the timing controller 140 generates control signals using the various timing signals received from the external source, and supplies the control signals to the gate driving circuit 120 and the data driving circuit 130.

For example, the timing controller 140 generates various gate control signals, including a gate start pulse GSP, a gate clock GCLK, and a gate output enable signal GOE, to control the gate driving circuit 120. Here, the gate start pulse GSP is used to control the start timing of one or more gate driving integrated circuits GDIC of the gate driving circuit 120. In addition, the gate clock GCLK is a clock signal commonly supplied to the one or more gate driving integrated circuits GDIC for controlling the shift timing of the scan signals. The gate output enable signal GOE designates timing information of the one or more gate driving integrated circuits GDIC.

In addition, the timing controller 140 generates various data control signals, including a source start pulse SSP, a source sampling clock SSC, and a source output enable signal SOE, to control the data driving circuit 130. Here, the source start pulse SSP is used to control the start timing for the data sampling of one or more source driving integrated circuits SDIC of the data driving circuit 130. The source sampling clock SSC is a clock signal for controlling a timing of data sampling in each of the source driving integrated circuits SDIC. The source output enable signal SOE controls the output timing of the data driving circuit 130.

The display device 100 may further include a power management integrated circuit for supplying or controlling various voltage or current to the display panel 110, the gate driving circuit 120, and the data driving circuit 130.

A light emitting element may be disposed in each of the subpixels SP. For example, the electroluminescence display device may include a light emitting element, such as a light emitting diode in each of the subpixels SP, and may display an image by controlling current flowing through the light emitting elements in response to the data voltage.

Figure 2:
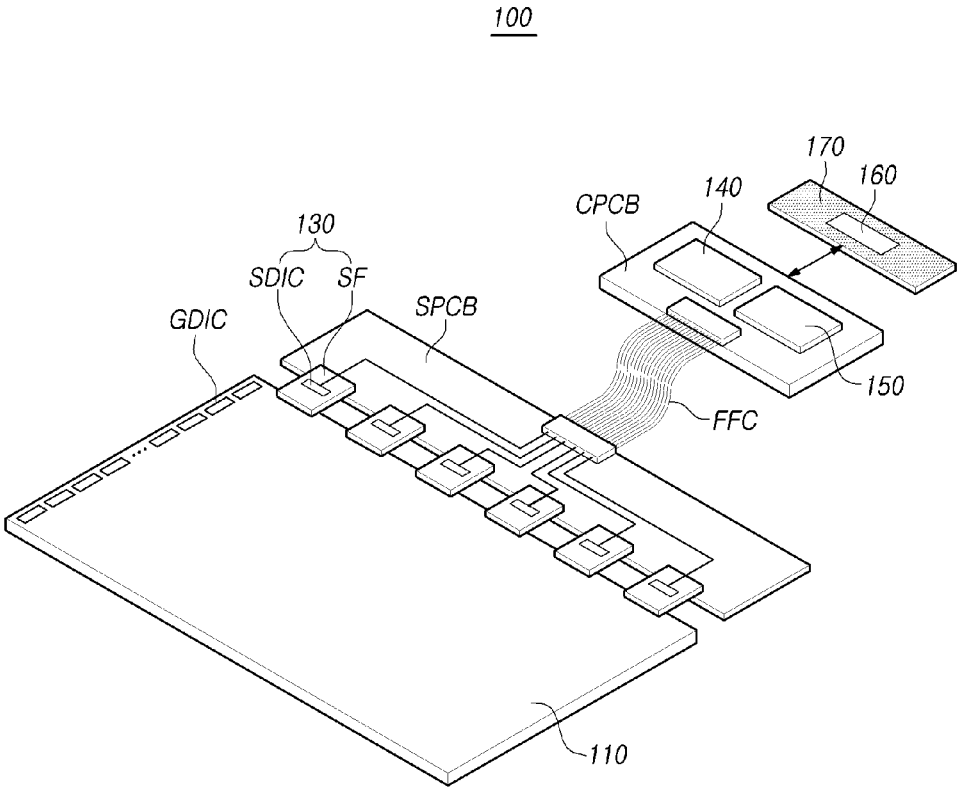
FIG. 2 illustrates a system diagram of the display device according to embodiments of the present disclosure.

FIG. 2 illustrates a system diagram of the display device according to embodiments of the present disclosure.

As an example, FIG. 2 illustrates that each of the source driving integrated circuits SDIC of the data driving circuit 130 in the display device 100 according to embodiments of the present disclosure is implemented with a COF type among various structures among various structures such as a TAB, a COG, and a COF, and the gate driving circuit 120 is implemented with a GIP type among various structures such as a TAB, a COG, a COF, and a GIP.

When the gate driving circuit 120 is implemented in a GIP type, the plurality of gate driving integrated circuits GDIC of the gate driving circuit 120 may be directly formed in a non-display area of the display panel 110. At this time, the gate driving integrated circuits GDIC may receive various signals (e.g., clock signal, gate high signal, gate low signal, etc.) necessary for generating the scan signal through the signal lines related to gate driving operation arranged in the non-display area.

Likewise, the data driving circuit 130 may include one or more source driving integrated circuits SDIC, which may be mounted on a source film SF, respectively. One portion of the source film SF may be electrically connected to the display panel 110. In addition, electrical lines may be disposed on the source films SF to electrically connect the source driving integrated circuits SDIC and the display panel 110.

The display device 100 may include at least one source printed circuit board SPCB in order to connect the plurality of source driving integrated circuits SDIC to other devices by electrical circuit, and a control printed circuit board CPCB in order to mount various control components and electric elements.

The other portion of the source film SF, on which the source driving integrated circuit SDIC is mounted, may be connected to the at least one source printed circuit board SPCB. That is, one portion of source film SF on which the source driving integrated circuit SDIC is mounted may be electrically connected to the display panel 110, and the other portion of the source film SF may be electrically connected to the source printed circuit board SPCB.

The timing controller 140 and a power management integrated circuit 150 may be mounted on the control printed circuit board CPCB. The timing controller 140 may control the operations of the data driving circuit 130 and the gate driving circuit 120. The power management integrated circuit 150 may supply a driving voltage and a driving current, or control a voltage and a current for the data driving circuit 130 and the gate driving circuit 120.

At least one source printed circuit board SPCB and the control printed circuit board CPCB may have circuitry connection by at least one connecting member. The connecting member may be, for example, a flexible printed circuit FPC, a flexible flat cable FFC, or the like. At least one source printed circuit board SPCB and the control printed circuit board CPCB may be integrated into a single printed circuit board.

The display device 100 may further include a set board 170 electrically connected to the control printed circuit board CPCB. The set board 170 may also be referred to as a power board. A main power management circuit M-PMC 160 managing overall power of the display device 100 may be located on the set board 170. The main power management circuit 160 may be coupled to the power management integrated circuit 150.

In the display device 100 having the above described configuration, a driving voltage is generated by the set board 170 to be supplied to the power management integrated circuit 150. The power management integrated circuit 150 supplies the driving voltage, which is required for a display driving operation or a sensing operation of the characteristic value, to the source printed circuit board SPCB through the flexible printed circuit FPC or the flexible flat cable FFC. The driving voltage supplied to the source printed circuit board SPCB, is transmitted to emit or sense a specific subpixel SP in the display panel 110 via the source driving integrated circuits SDIC.

Each of the subpixels SP arranged in the display panel 110 of the display device 100 may include a light emitting element and circuit elements, such as a driving transistor to drive it.

The type and number of the circuit elements constituting each of the subpixels SP may be variously determined depending on the function, the design, or the like.

Figure 3:
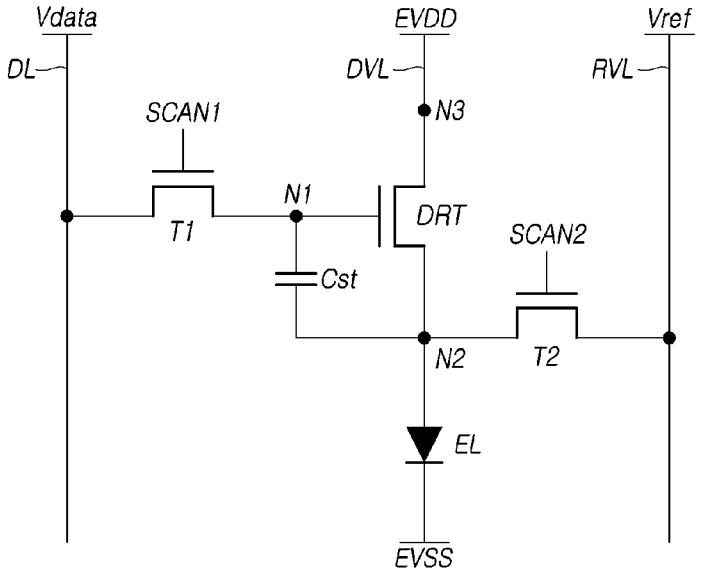
FIG. 3 illustrates a circuit diagram of a subpixel in the display device according to embodiments of the present disclosure.

FIG. 3 illustrates a circuit diagram of a subpixel in the display device according to embodiments of the present disclosure.

Referring to FIG. 3, each of the subpixels SP arranged in the display device 100 according to embodiments of the present disclosure may include one or more transistors, a capacitor, and a light emitting element.

For example, a subpixel SP may include a driving transistor DRT, a first scan transistor T1, a second scan transistor T2, a storage capacitor Cst, and a light emitting diode EL.

The driving transistor DRT may have a first node N1, a second node N2, and a third node N3. The first node N1 of the driving transistor DRT may be a gate node to be supplied a data voltage Vdata through a data line DL when the first scan transistor T1 is turned on.

The second node N2 of the driving transistor DRT may be electrically connected to an anode electrode of the light emitting diode EL, and may be a drain node or a source node.

The third node N3 of the driving transistor DRT may be electrically connected to a driving voltage line DVL to be supplied a driving voltage EVDD, and may be a source node or a drain node.

Here, the driving voltage EVDD for displaying an image may be supplied to the driving voltage line DVL in the display driving period. For example, the driving voltage EVDD for displaying the image may be about 27 V.

The first scan transistor T1 is electrically connected between the first node N1 of the driving transistor DRT and the data line DL, and operates in response to a first scan signal SCAN1 supplied thereto through the gate line GL connected to the gate node. In addition, it controls the operation of the driving transistor DRT by transmitting the data voltage Vdata through the data line DL to the gate node of the driving transistor DRT when the first scan transistor T1 is turned on.

The second scan transistor T2 is electrically connected between the second node N2 of the driving transistor DRT and a reference voltage line RVL, and operates in response to a second scan signal SCAN2 supplied through the gate line GL connected to a gate node. When the second scan transistor T2 is turned on, a reference voltage Vref supplied from the reference voltage line RVL is transmitted to the second node N2 of the driving transistor DRT.

That is, the voltages of the first node N1 and the second node N2 of the driving transistor DRT may be controlled by controlling the first scan transistor T1 and the second scan transistor T2. Consequently, a current for emitting the light emitting diode EL may be supplied.

Each gate node of the first scan transistor T1 and the second scan transistor T2 may be connected to a single gate line GL or to different gate lines GL. Here, it illustrates an exemplary structure of which the first scan transistor T1 and the second scan transistor T2 are connected to a different gate lines GL. In this case, the first scan transistor T1 and the second scan transistor T2 are controlled independently by the first scan signal SCAN1 and the second scan signal SCAN2 transmitted from the different gate lines GL.

On the other hand, when the first scan transistor T1 and the second scan transistor T2 are connected to single gate line GL, the first scan transistor T1 and the second scan transistor T2 are controlled simultaneously by the first scan signal SCAN1 or the second scan signal SCAN2 transmitted from the single gate line GL, and thus the aperture ratio of the subpixels SP may be improved.

In addition, the transistors disposed in the subpixels SP may be not only n-type transistors, but also p-type transistors. Herein, it illustrates the exemplary structure of the n-type transistors.

The storage capacitor Cst is electrically connected between the first node N1 and the second node N2 of the driving transistor DRT, and is configured to maintain the data voltage Vdata during a frame.

Such a storage capacitor Cst may be connected between the first node N1 and the third node N3 of the driving transistor DRT according to a type of the driving transistor DRT. The anode electrode of the light emitting diode EL may be electrically connected to the second node N2 of the driving transistor DRT, and a base voltage EVSS may be supplied to a cathode electrode of the light emitting diode EL.

Here, the base voltage EVSS may be the ground voltage or a voltage higher or lower than the ground voltage. In addition, the base voltage EVSS may be varied depending on the driving condition. For example, the base voltage EVSS during the display driving period may be different from the base voltage EVSS during the sensing period.

The first scan transistor T1 and the second scan transistor T2 may be referred to as scan transistors controlled by scan signals SCAN1, SCAN2.

The structure of the subpixel SP may further includes one or more transistors, or in some cases, further includes one or more capacitors.

The display device 100 according to an embodiment of the present disclosure may use a method for measuring a current flowing by voltage charged in the storage capacitor Cst during a sensing period of the characteristic value for the driving transistor DRT in order to effectually sense the characteristic value of the driving transistor DRT like threshold voltage or mobility. Such a method may be referred to as a current sensing operation.

That is, the characteristic value or variation of the characteristic value of the driving transistor DRT in the subpixel SP may be determined by measuring the current flowing by voltage charged in the storage capacitor Cst during the sensing period of the characteristic value for the driving transistor DRT.

At this time, the reference voltage line RVL may be referred to as a sensing line since the reference voltage line RVL serves not only to supply the reference voltage Vref but also serves as a sensing line for sensing the characteristic value of the characteristic value for the driving transistor DRT in the subpixel SP.

More specifically, the characteristic value or variation of the characteristic value for the driving transistor DRT may correspond to a difference between the voltage of the first node N1 and the voltage of the second node N2 of the driving transistor DRT.

The compensation for the characteristic value of the driving transistor DRT may be performed as an internal compensation that senses and compensates the characteristic value of the driving transistor DRT inside the subpixel SP without using an external additional configuration, or as an external compensation that senses and compensates the characteristic value of the driving transistor DRT by using an external compensation circuit.

In this case, the external compensation may be performed before the shipment of the display device 100, and the internal compensation may be performed after the shipment of the display device 100. On the other hand, the internal compensation and the external compensation may be performed together after the shipment of the display device 100.

Figure 4:
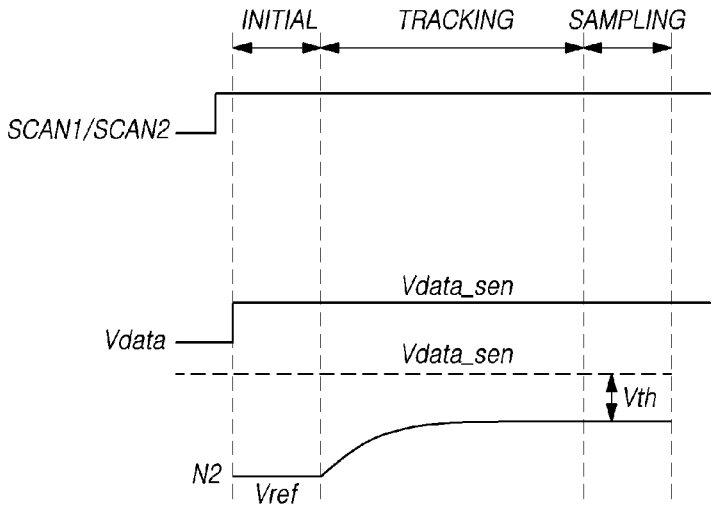
FIG. 4 illustrates a signal timing diagram of external compensation for a threshold voltage of a driving transistor in the display device according to embodiments of the present disclosure.

FIG. 4 illustrates a signal timing diagram of external compensation for a threshold voltage of a driving transistor in the display device according to embodiments of the present disclosure.

Referring to FIG. 4, a sensing process for the threshold voltage Vth of the driving transistor DRT may be comprised of an initializing period INITIAL, a tracking period TRACKING, and a sampling period SAMPLING.

Since the first scan transistor T1 and the second scan transistor T2 are simultaneously turned on and turned off for sensing the threshold voltage Vth of the driving transistor DRT, the first scan signal SCAN1 and the second scan signal SCAN2 may be supplied simultaneously through a gate line GL or the first scan signal SCAN1 and the second scan signal SCAN2 may be supplied at the same time through different gate lines GL.

The initializing period INITIAL is a period to charge the second node N2 of the driving transistor DRT with the reference voltage Vref for sensing the threshold voltage Vth of the driving transistor DRT, and the first scan signal SCAN1 and the second scan signal SCAN2 with a high level may be supplied through the gate line GL.

The tracking period TRACKING is a period to charge the storage capacitor Cst after completing the charge for the second node N2 of the driving transistor DRT.

The sampling period SAMPLING is a period to detect a current flowing by the capacitance charged in the storage capacitor Cst after the storage capacitor Cst of the driving transistor DRT is charged.

In the initializing period INITIAL, the first scan transistor T1 is turned on by supplying simultaneously the first scan signal SCAN1 and the second scan signal SCAN2 with turn-on level. As a result, the first node N1 of the driving transistor DRT is initialized to the data voltage-for-sensing Vdata_sen for sensing the threshold voltage Vth.

In addition, the first scan signal SCAN1 and the second scan signal SCAN2 with a turn-on level cause the second scan transistor T2 to be turned on. In this state, the second node N2 of the driving transistor DRT is initialized to the reference voltage Vref by the reference voltage Vref supplied through the reference voltage line RVL.

The tracking period TRACKING is a period to track the second node N2 of the driving transistor DRT corresponding to the threshold voltage Vth of the driving transistor DRT. In the tracking period TRACKING, the first scan transistor T1 and the second scan transistor T2 are maintained to turn-on level and the reference voltage Vref transmitted through the reference voltage line RVL is blocked.

Accordingly, the second node N2 of the driving transistor DRT is floated, so that the voltage of the second node N2 of the driving transistor DRT is increased from the reference voltage Vref. At this time, since the second scan transistor T2 is turned on, the rising voltage at the second node N2 of the driving transistor DRT leads to the rise of the voltage at the reference voltage line RVL.

In this process, the voltage at the second node N2 of the driving transistor DRT rises and becomes a saturation state. The saturation voltage at the second node N2 of the driving transistor DRT at the saturation state corresponds to the difference (Vdata_sen−Vth) between the data voltage-for-sensing Vdata_sen for sensing the threshold voltage Vth and the threshold voltage Vth of the driving transistor DRT.

In the sampling period SAMPLING, the first scan signal SCAN1 and the second scan signal SCAN2 with a high level are maintained in the gate line GL, the initializing switch SW1 in the sensing circuit 134 of the characteristic value is turned off, and a sensing circuit of characteristic value included in the data driving circuit 130 senses the charge in the storage capacitor Cst of the driving transistor DRT.

Figure 5:
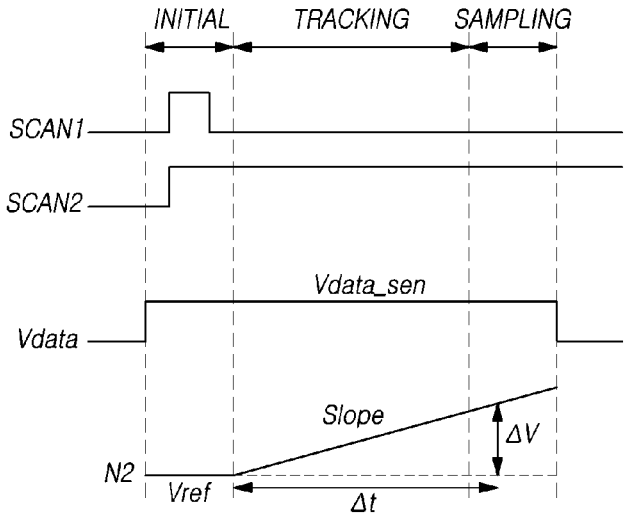
FIG. 5 illustrates a signal timing diagram of external compensation for mobility of the driving transistor in the display device according to embodiments of the present disclosure.

FIG. 5 illustrates a signal timing diagram of external compensation for mobility of the driving transistor in the display device according to embodiments of the present disclosure.

Referring to FIG. 5, a sensing process for the mobility of the driving transistor DRT in the display device 100 according to embodiments of the present disclosure may be comprised of an initializing period INITIAL, a tracking period TRACKING, and a sampling period SAMPLING like the sensing process for the threshold voltage Vth.

In the initializing period INITIAL, the first scan transistor T1 is turned on by the first scan signal SCAN1 with the turn-on level, so that the first node N1 of the driving transistor DRT is initialized to the data voltage Vdata for sensing the mobility. In addition, the second scan signal SCAN2 with a turn-on level causes the second scan transistor T2 to be turned on. In this state, the second node N2 of the driving transistor DRT is initialized to the reference voltage Vref.

The tracking period TRACKING is a period to track the mobility of the driving transistor DRT. The mobility of the driving transistor DRT may indicate current driving ability of the driving transistor DRT. In the tracking period TRACKING, the voltage at the second node N2 of the driving transistor DRT is tracked for determining the mobility of the driving transistor DRT.

In the tracking period TRACKING, the first scan transistor T1 is turned off by the first scan signal SCAN1 with a turn-off level, and a switch to receive the reference voltage Vref is blocked. Consequently, both the first node N1 and the second node N2 of the driving transistor DRT are floated, so that both the voltage at the first node N1 and the voltage at the second node N2 of the driving transistor DRT are increased.

In particular, since the voltage at the second node N2 of the driving transistor DRT was initialized to the reference voltage Vref, it is increased from the reference voltage Vref. At this time, an increase of the voltage at the second node N2 of the driving transistor DRT causes an increase of the voltage at the reference voltage line RVL, since the second scan transistor T2 is in the turned-on state.

In the sampling period SAMPLING, the sensing circuit of characteristic value detects the voltage at the second node N2 of the driving transistor DRT at a point that a predetermined time Δt has elapsed from the time when the voltage of the second node N2 of the driving transistor DRT starts to increase.

At this time, the sensing voltage detected by the sensing circuit of characteristic value may correspond to a voltage (Vref+ΔV) increased from the reference voltage Vref by some voltage ΔV. Accordingly, the mobility of the driving transistor DRT may be determined by using the sensing voltage (Vref+ΔV), the known reference voltage Vref, and the charging time ΔT of the feedback capacitor Cfb.

That is, the mobility of the driving transistor DRT is proportional to the voltage variation per unit time ΔV/Δt of the reference voltage line RVL through the tracking period TRACKING and the sampling period SAMPLING. Therefore, the mobility of the driving transistor DRT may be proportional to the slope of the voltage in the reference voltage line RVL.

Figure 6:
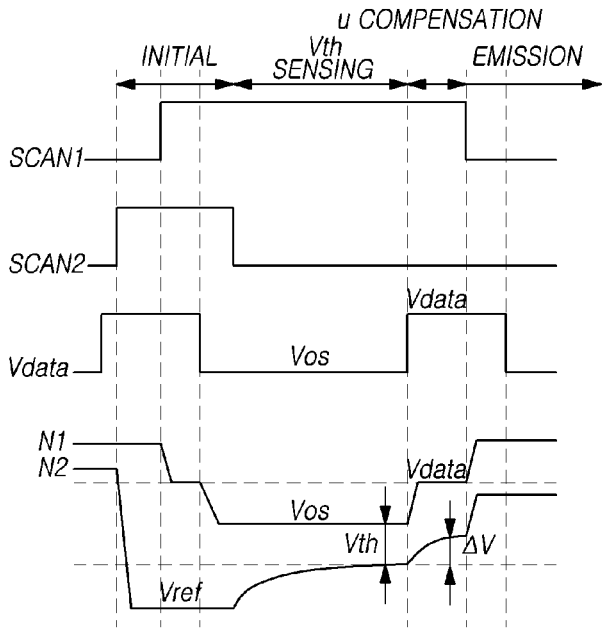
FIG. 6 illustrates a signal timing diagram of internal compensation for a threshold voltage and mobility of the driving transistor in the display device according to embodiments of the present disclosure.

FIG. 6 illustrates a signal timing diagram of internal compensation for a threshold voltage and mobility of the driving transistor in the display device according to embodiments of the present disclosure.

Referring to FIG. 6, the internal compensation process for the characteristic value of the driving transistor DRT in the display device 100 according to embodiments of the present disclosure may include an initialization period INITIAL, a threshold voltage sensing period Vth SENSING, a mobility compensation period u COMPENSATION, and a light emission period EMISSION.

In the initialization period INITIAL, the second scan transistor T2 is first turned on by the second scan signal SCAN2 with a high level, and the voltage of the second node N2, that is, the source node voltage of the driving transistor DRT is initialized to the reference voltage Vref.

Thereafter, the first scan transistor T1 is turned on by the first scan signal SCAN1 with a high level, and the driving transistor DRT is turned on by the data voltage Vdata being supplied to the first node N1, that is, the gate node of the driving transistor DRT. Subsequently, when the data voltage Vdata is lowered to the level of the offset voltage Vos, the voltage of the first node N1 becomes the level of the offset voltage Vos.

When the second scan transistor T2 is turned off by the second scan signal SCAN2 being supplied at a low level in the threshold voltage sensing period Vth SENSING, the voltage of the second node N2 through the driving transistor DRT rises to the difference voltage between the offset voltage Vos and the threshold voltage Vth of the driving transistor DRT, and eventually the storage capacitor Cst is charged to the level of the threshold voltage Vth.

In the mobility compensation period u COMPENSATION, the first node N1 rises to the level of the data voltage Vdata by supplying a gray scale to be displayed, that is, the corresponding data voltage Vdata to the display panel 110. Accordingly, the second node N2 is gradually charged according to the mobility characteristic of the driving transistor DRT, and as a result, difference voltage obtained by subtracting the voltage variation ΔV according to the offset voltage Vos and the mobility from the sum of the data voltage Vdata and the threshold voltage Vth is stored in the storage capacitor Cst.

In the emission period EMISSION, the first scan transistor T1 is turned off by the first scan signal SCAN1 being supplied with a low level. Accordingly, a current in which the threshold voltage Vth and the mobility of the driving transistor DRT are compensated by the voltage level stored in the storage capacitor Cst is supplied to the light emitting diode EL.

The internal or external compensation may be performed after a power-on signal is generated and before the display driving operation is started. For example, when the power-on signal is supplied to the display device 100, the timing controller 140 loads parameters necessary for driving the display panel 110 and then performs a display driving operation. In this case, the parameters necessary for driving the display panel 110 may include information about the sensing process and compensation process for characteristic value previously performed by the display panel 110. The sensing process for the characteristic value (the threshold voltage or the mobility) of the driving transistor DRT may be performed during the parameter loading process. As described above, the sensing process for the characteristic value during the parameter loading process after the power-on signal is generated may be referred to as an on-sensing process.

Alternatively, the sensing process for the characteristic value of the driving transistor DRT may be performed after the power-off signal for the display device 100 is generated. For example, when the power-off signal is generated in the display device 100, the timing controller 140 may terminate the image display process in the display panel 110, and perform the sensing process for the characteristic value of the driving transistor DRT during a predetermined time. In this way, the sensing process for the characteristic value in a state in which the power-off signal is generated and the image displaying process is terminated may be referred to as an off-sensing process.

In addition, the sensing period for the characteristic value of the driving transistor DRT may be performed in real time while the display driving process is progressed. This sensing process may be referred to as a real-time RT sensing process. In the case of the real-time sensing process, the sensing process may be performed for one or more subpixels SP in one or more subpixel lines for each blank period during the display driving period.

That is, a blank period in which the data voltage is not supplied to the subpixel SP may exist within one frame or between the nth frame and the (n+1)th frame during the display driving period in which an image is displayed on the display panel 110. Accordingly, the sensing and compensation process of the characteristic value for one or more subpixels SP may be performed in the blank period.

As described above, when the sensing process is performed in the blank period, the subpixel SP line on which the sensing process is performed may be randomly selected. Accordingly, abnormal phenomenon that may appear in the display driving period may be diminished after the sensing process in the blank period is performed. In addition, after the sensing process is performed during the blank period, a recovery data voltage may be supplied to the subpixel SP on which the sensing process was performed during the display driving period. Accordingly, abnormal phenomenon in the subpixel SP line for which the sensing process is completed in the display driving period after the sensing process in the blank period may be further diminished.

At this time, since the sensing process for the threshold voltage of the driving transistor DRT may take a long time for saturating the voltage at the second node N2 of the driving transistor DRT, the sensing and compensating process for the threshold voltage Vth is mainly performed in the off-sensing process. On the other hand, since the sensing process for the mobility of the driving transistor DRT takes a relatively short time compared to the sensing process for the threshold voltage Vth, the sensing and compensating process for the mobility may be performed in the real-time sensing process.

As described above, the sensing process for sensing the characteristic value of the driving transistor DRT is required of a process that the first scan transistor T1 and the second scan transistor T2 are turned on, and the second node N2 is maintained at the reference voltage Vref through the reference voltage line RVL before the initialization period INITIAL.

At this time, the reference voltage Vref cannot always be maintained at a high level and may be changed to a high level or a low level according to the driving state of the display device 100 because the display driving period for displaying an image on the display device 100 and the sensing driving period for sensing and compensating the characteristic value may be alternately performed.

Figure 7:
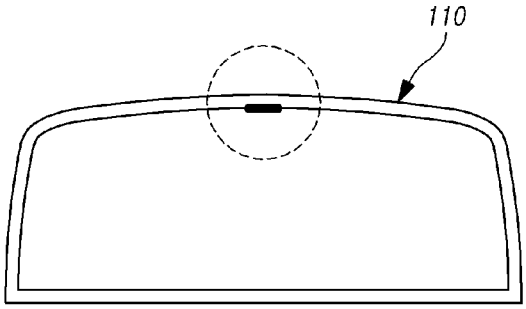
FIG. 7 illustrates a diagram of a case in which a light emission error occurs in a partial area due to an error of a reference voltage in the display device according to embodiments of the present disclosure.

However, when the reference voltage Vref is not supplied to the second node N2 while the first scan transistor T1 and the second scan transistor T2 are turned off for sensing characteristic values, the reference voltage line RVL is in a floating state. As a result, a voltage of the anode electrode of the light emitting diode EL rises, and a light emission error in which some regions of the display panel 110 emit lights may be occurred as shown in FIG. 7.

The display device 100 of the present disclosure may reduce the light emission error by maintaining the reference voltage Vref of the reference voltage line RVL at the level of turning off the light emitting diode EL while the scan transistors T1, T2 are turned off before the sensing process for sensing the characteristic value of the driving transistor DRT is performed.

Figure 8:
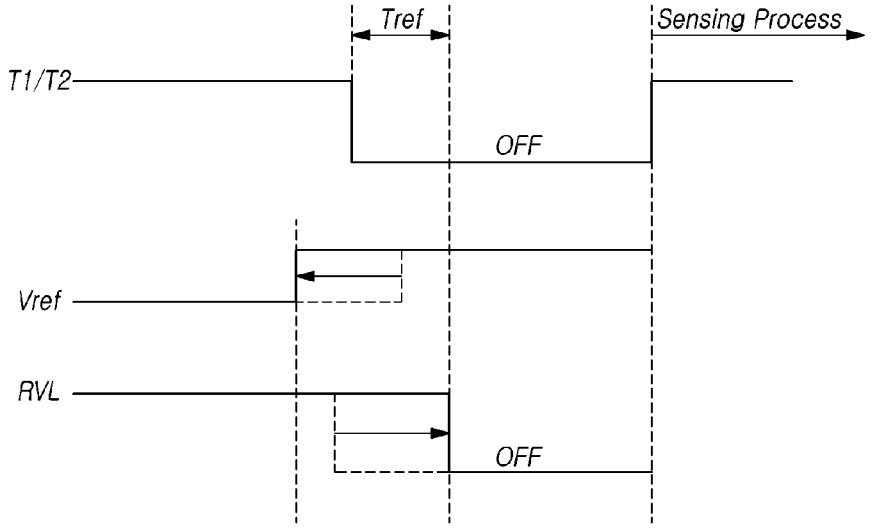
FIG. 8 illustrates a conceptual signal timing diagram for reducing a light emission error in the display device according to embodiments of the present disclosure.

FIG. 8 illustrates a conceptual signal timing diagram for reducing a light emission error in the display device according to embodiments of the present disclosure.

Referring to FIG. 8, the display device 100 according to embodiments of the present disclosure may reduce a light emission error appearing at the start of the sensing process by keeping the light emitting diode EL in a stable turn-off state before the sensing process for sensing the characteristic value of the driving transistor DRT disposed in the subpixel SP.

For the purpose of above, the display device 100 of the present disclosure supplies a reference voltage Vref of the level at which the light emitting diode EL is turned off through the reference voltage line RVL in a state that the first scan transistor T1, which controls an on-off time of the driving transistor DRT by the first scan signal SCAN1, and the second scan transistor T2, which controls the sensing time for the anode electrode of the light emitting diode EL by the second scan signal SCAN2, are turned off.

Here, the first scan transistor T1, which controls an on-off time of the driving transistor DRT by the first scan signal SCAN1, and the second scan transistor T2, which controls the sensing time for the anode electrode of the light emitting diode EL by the second scan signal SCAN2, correspond to scan transistors, and may be corresponded to the first scan transistor T1 and the second scan transistor T2 in the subpixel SP of FIG. 3.

The first scan transistor T1 and the second scan transistor T2 may be in a turn-off state before the sensing process is performed, and then may be turned on when the sensing process is performed.

In this case, when the reference voltage line RVL is turned off or the reference voltage Vref is not supplied to the reference voltage line RVL in a state that the first scan transistor T1 and the second scan transistor T2 are turned off, the reference voltage line RVL is in a floating state, and the voltage of the reference voltage line RVL increases due to coupling with an adjacent node, thereby causing a light emission error.

To reduce this error, when the first scan transistor T1 and the second scan transistor T2 are turned off before the sensing process is performed, the reference voltage line RVL is turned on and a reference voltage Vref of a level to turn off the light emitting diode EL may be supplied. As a result, it is possible to reduce a light emission error of the light emitting diode EL.

Accordingly, in one embodiment the reference voltage Vref is supplied at the same time as or earlier than a time when the first scan transistor T1 and the second scan transistor T2 are turned off.

In addition, even when the first scan transistor T1 and the second scan transistor T2 are turned off, the reference voltage line RVL needs to be maintained in a turn-on state for a predetermined time.

Accordingly, for a time period Tref from a time when the first scan transistor T1 and the second scan transistor T2 are turned off to a time when the reference voltage line RVL is turned off, the reference voltage Vref of a level for turning off the light emitting diode EL may be supplied to the reference voltage line RVL. Therefore, it is possible to reduce light emission errors emitted by the subpixel SP before the sensing process is performed.

Particularly, the display device 100 of the present disclosure may be applied not only to the subpixel SP having a 3T1C structure, as shown in FIG. 3, but also to various types of subpixel SP structures additionally including a transistor or a capacitor.

In the following, an additional subpixel SP structure that may be configured in the display device 100 of the present disclosure will be described in more detail.

Figure 9:
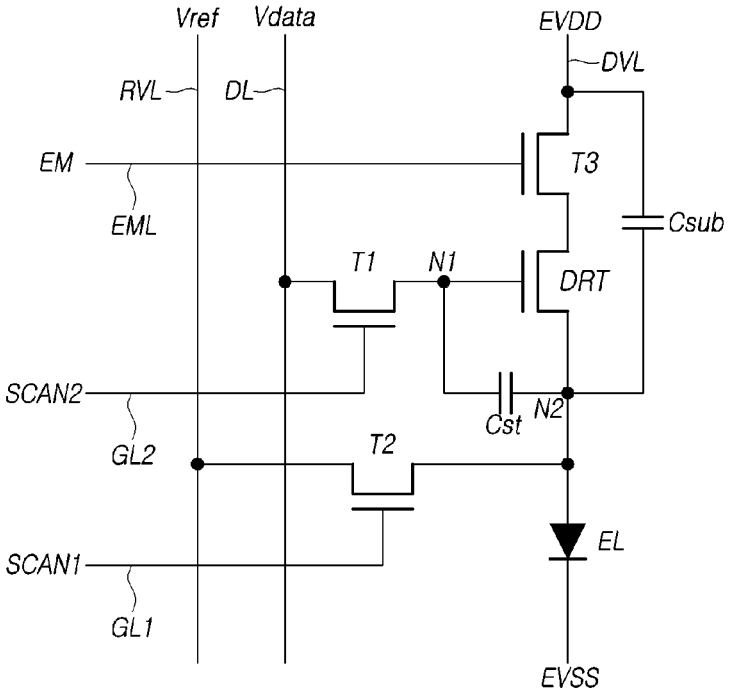
FIG. 9 illustrates another circuit diagram of a subpixel in a display device according to embodiments of the present disclosure.

FIG. 9 illustrates another circuit diagram of a subpixel in a display device according to embodiments of the present disclosure.

Referring FIG. 9, the subpixel SP of the display device 100 according to embodiments of the present disclosure may include a light emitting diode EL, a driving transistor DRT, first to third scan transistors T1, T2, T3, a storage capacitor Cst, and an auxiliary capacitor Csub.

The light emitting diode EL emits light using a driving current supplied from the driving transistor DRT. A multi-layered organic compound layer is formed between the anode electrode and the cathode electrode of the light emitting diode EL. The organic compound layer may include a hole injection layer (HIL), a hole transport layer (HTL), an emission layer, an electron transport layer (ETL), and an electron injection layer (EIL).

The anode electrode of the light emitting diode EL is connected to the second node N2, which is a source node of the driving transistor DRT, and the cathode electrode is connected to the base voltage EVSS.

The driving transistor DRT controls a driving current which is supplied to the light emitting diode EL using a voltage charged to the storage capacitor Cst connecting the first node N1 as the gate node to the second node N2 as the source node. For the purpose of it, the gate node of the driving transistor DRT is connected to the data line DL to which the data voltage Vdata is supplied through the first scan transistor T1, and the drain node is connected to the driving voltage line DVL to which the driving voltage EVDD is supplied through the third scan transistor T3.

The third scan transistor T3 controls the current path between the driving voltage line DVL and the driving transistor DRT in response to the emission control signal EM supplied through the emission line EML. For the purpose of it, the gate node of the third scan transistor T3 is connected to the emission line EML, the drain node is connected to the driving voltage line DVL, and the source node is connected to the drain node of the driving transistor DRT.

The second scan transistor T2 supplies the reference voltage Vref supplied from the reference voltage line RVL to the second node N2 in response to the first scan signal SCAN1 supplied through the first gate line GL1. For the purpose of it, the gate node of the second scan transistor T2 is connected to the first gate line GL1, the drain node is connected to the reference voltage line RVL, and the source node is connected to the second node N2.

The first scan transistor T1 supplies the data voltage Vdata supplied through the data line DL to the gate node of the driving transistor DRT in response to the second scan signal SCAN2 supplied through the second gate line GL2. For the purpose of it, the gate node of the first scan transistor T1 is connected to the second gate line GL2, the drain node is connected to the data line DL, and the source node is connected to the gate node N1 of the driving transistor DRT.

The storage capacitor Cst forms a voltage between the gate node N1 and the source node N2 of the driving transistor DRT by maintaining the data voltage Vdata supplied from the data line DL through the first scan transistor T1 for one frame. For the purpose of it, the storage capacitor Cst is connected between the gate node N1 and the source node N2 of the driving transistor DRT.

The auxiliary capacitor Csub is connected between the driving voltage line DVL and the second node N2, and is connected in series with the storage capacitor Cst at the second node N2. Accordingly, it improves an efficiency of the data voltage Vdata.

Meanwhile, the transistors disposed in the subpixel SP may be formed of p-type transistors or n-type transistors. Here, it illustrates a case that n-type transistors are configured.

The first to third scan transistors T1-T3 are scan transistors.

As described above, the subpixel SP including four transistors DRT, T1, T2, T3 and two capacitors Cst, Csub may be referred to as a 4T2C structure.

Figure 10:
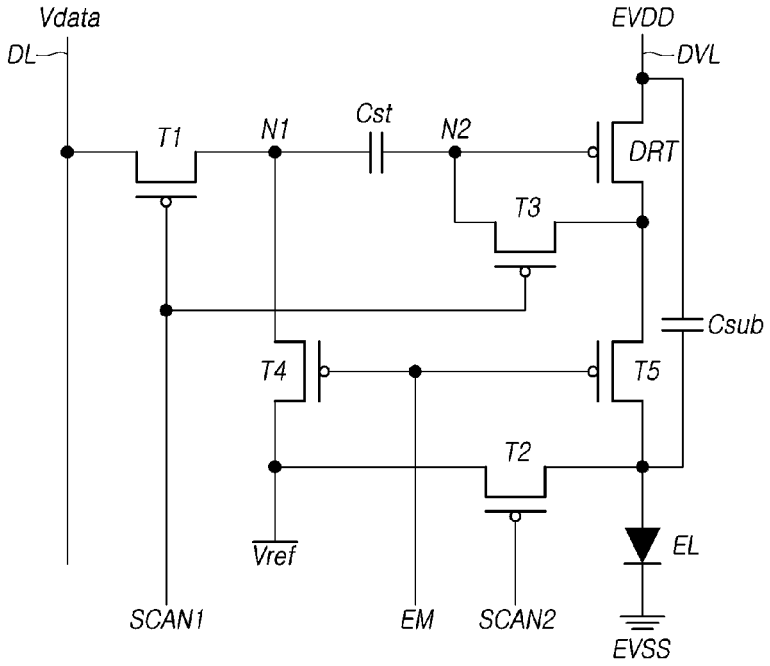
FIG. 10 illustrates another circuit diagram of a subpixel in a display device according to embodiments of the present disclosure.

FIG. 10 illustrates another circuit diagram of a subpixel in a display device according to embodiments of the present disclosure.

Referring to FIG. 10, the subpixel SP in the display device 100 according to embodiments of the present disclosure may include a first scan transistor T1, a second scan transistor T2, a third scan transistor T3, a fourth scan transistor T4, a fifth scan transistor T5, a driving transistor DRT, and a storage capacitor Cst.

The first scan transistor T1 is configured to transmit the data voltage Vdata supplied through the data line DL in response to the first scan signal SCAN1.

The third scan transistor T3 is configured to sense a threshold voltage of the driving transistor DRT by connecting the gate node N2 and the source node of the driving transistor DRT in response to the first scan signal SCAN1.

The second scan transistor T2 is configured to supply the reference voltage Vref to the anode electrode of the light emitting diode EL in response to the second scan signal SCAN2.

The fourth scan transistor T4 is configured to supply the reference voltage Vref to the first node N1 to which the first scan transistor T1 and the storage capacitor Cst are connected in response to the emission control signal EM.

The fifth scan transistor T5 is configured to control a driving current flowing to the anode electrode of the light emitting diode EL in response to the light emission control signal EM.

The storage capacitor Cst is configured to store the data voltage Vdata. The driving transistor DRT is configured to generate a driving current according to the data voltage Vdata stored in the storage capacitor Cst. The auxiliary capacitor Csub is connected between the driving voltage EVDD and the anode electrode of the light emitting diode EL, and controls a time for charging the current in the light emitting diode EL.

Meanwhile, the transistors disposed in the subpixel SP may be formed of p-type transistors as well as n-type transistors. Here, it illustrates a case that p-type transistors are configured.

The first to fifth scan transistors T1-T5 are scan transistors.

As described above, the subpixel SP including six transistors DRT, T1, T2, T3, T4, T5 and two capacitors Cst, Csub may be referred to as a 6T2C structure.

Figure 11:
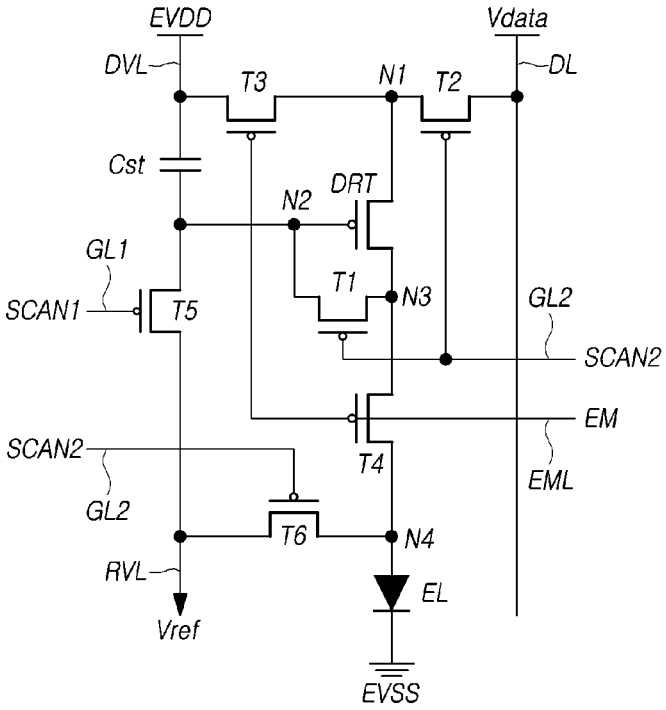
FIG. 11 illustrates another circuit diagram of a subpixel in a display device according to embodiments of the present disclosure.

FIG. 11 illustrates another circuit diagram of a subpixel in a display device according to embodiments of the present disclosure.

Referring to FIG. 11, the subpixel SP in the display device 100 according to embodiments of the present disclosure may include a light emitting diode EL, a driving transistor DRT, first to sixth scan transistors T1-T6 and a storage capacitor Cst.

The light emitting diode EL emits light by a driving current supplied from the driving transistor DRT. The anode electrode of the light emitting diode EL may be electrically connected to the fourth node N4, and the cathode electrode of the light emitting diode EL may be electrically connected to the base voltage EVSS corresponding to the low potential driving voltage.

The driving transistor DRT controls the driving current supplied to the light emitting diode EL according to the voltage Vgs between the gate node and the source node.

The source node of the driving transistor DRT may be connected to the first node N1, the gate node may be connected to the second node N2, and the drain node may be connected to the third node N3.

The first scan transistor T1 may be electrically connected between the second node N2 and the third node N3. That is, the first scan transistor T1 may be electrically connected between the gate node and the drain node of the driving transistor DRT.

The drain node or the source node of the first scan transistor T1 is electrically connected to the second node N2, and the source node or the drain node of the first scan transistor T1 is connected to the third node N3. The gate node of the first scan transistor T1 may be electrically connected to the second gate line GL2.

The first scan transistor T1 may electrically connect the gate node and the drain node of the driving transistor DRT in response to the second scan signal SCAN2 supplied through the second gate line GL2. Here, the electrical connection between the gate node and the drain node of the driving transistor DRT may be referred as a diode connection.

The second scan transistor T2 may be electrically connected between the data line DL and the first node N1. That is, the second scan transistor T2 may be electrically connected between the data line DL and the source node of the driving transistor DRT.

The drain node or the source node of the second scan transistor T2 may be electrically connected to the first node N1, and the source node or the drain node of the second scan transistor T2 may be connected to the data line DL. The gate node of the second scan transistor T2 may be electrically connected to the second gate line GL2.

The second scan transistor T2 may transmit the data voltage Vdata supplied from the data line DL to the first node N1 in response to the second scan signal SCAN2 supplied through the second gate line GL2.

The gate node of the first scan transistor T1 and the gate node of the second scan transistor T2 may be connected to the same second gate line GL2 in common. Accordingly, the first scan transistor T1 and the second scan transistor T2 may be turned on and off together.

The third scan transistor T3 may be electrically connected between the driving voltage line DVL and the first node N1. That is, the third scan transistor T3 may be electrically connected between the driving voltage line DVL and the source node of the driving transistor DRT.

A source node or a drain node of the third scan transistor T3 may be electrically connected to the driving voltage line DVL, and a drain node or a source node of the third scan transistor T3 may be electrically connected to the first node N1. The gate node of the third scan transistor T3 may be electrically connected to the emission line EML.

The third scan transistor T3 may transmit the driving voltage EVDD to the first node N1 in response to the emission control signal EM supplied through the emission line EML.

The fourth scan transistor T4 may be electrically connected between the third node N3 and the fourth node N4. That is, the fourth scan transistor T4 may be electrically connected between the drain node of the driving transistor DRT and the anode electrode of the light emitting diode EL.

The source node or the drain node of the fourth scan transistor T4 may be electrically connected to the third node N3, and the drain node or the source node of the fourth scan transistor T4 may be electrically connected to the fourth node N4. The gate node of the fourth scan transistor T4 may be electrically connected to the emission line EML.

The fourth scan transistor T4 forms a current path between the third node N3 and the fourth node N4 in response to the emission control signal EM supplied through the emission line EML.

The gate node of the third scan transistor T3 and the gate node of the fourth scan transistor T4 may be commonly connected to the same emission line EML. Accordingly, the third scan transistor T3 and the fourth scan transistor T4 may be turned on and off together.

The fifth scan transistor T5 may be electrically connected between the second node N2 and the reference voltage line RVL. That is, the fifth scan transistor T5 may be electrically connected between the gate node of the driving transistor DRT and the reference voltage line RVL.

The source node or the drain node of the fifth scan transistor T5 may be electrically connected to the reference voltage line RVL, and the drain node or the source node of the fifth scan transistor T5 may be electrically connected to the second node N2. The gate node of the fifth scan transistor T5 may be electrically connected to the first gate line GL1.

The fifth scan transistor T5 may transmit the reference voltage Vref to the second node N2 in response to the first scan signal SCAN1 supplied through the first gate line GL1.

The sixth scan transistor T6 may be electrically connected between the reference voltage line RVL and the fourth node N4. That is, the sixth scan transistor T6 may be electrically connected between the reference voltage line RVL and the anode electrode of the light emitting diode EL.

The source node or the drain node of the sixth scan transistor T6 may be electrically connected to the reference voltage line RVL, and the drain node or the source node of the sixth scan transistor T6 may be electrically connected to the fourth node N4. The gate node of the sixth scan transistor T6 may be electrically connected to the second gate line GL2.

The sixth scan transistor T6 may transmit the reference voltage Vref to the fourth node N4 in response to the second scan signal SCAN2 supplied through the second gate line GL2.

The first to sixth scan transistors T1-T6 are a kind of scan transistors.

The storage capacitor Cst may include a first plate electrically connected to the second node N2 and a second plate electrically connected to the driving voltage line DVL.

Here, the first gate line GL1, the second gate line GL2, and the emission line EML correspond to a kind of gate line GL, and the emission control signal EM corresponds to a kind of scan signal. In other words, it can be said that the first scan signal SCAN1 and the second scan signal SCAN2 correspond to a first type of scan signal, and the emission control signal EM corresponds to a second type of scan signal.

Accordingly, transistors T1, T2, T5, T6 receiving a first type of scan signal are referred to as a first type of transistor, and transistors T3, T4 receiving a second type of scan signal are referred to as a second type of transistor.

Meanwhile, the transistors disposed in the subpixel SP may be formed of p-type transistors as well as n-type transistors. Here, it illustrates a case that p-type transistors are configured.

In the above, a various circuit structure of the subpixel SP is illustrated as an example. The structure and number of transistors and capacitors constituting the subpixel SP may be variously changed. Meanwhile, each of the plurality of subpixels SP may have the same structure, and some of the plurality of subpixels SP may have a different structure.

The display device 100 of the present disclosure may reduce the light emission error by controlling a timing of the reference voltage Vref supplied to the reference voltage line RVL in accordance with a timing of the scan signal SCAN supplied to the gate line GL in order to maintain the reference voltage line RVL at a level of reference voltage Vref turning off the light emitting diode EL while the scan transistor is turned off, before the sensing process for sensing the characteristic value of the driving transistor DRT is performed.

Figure 12:
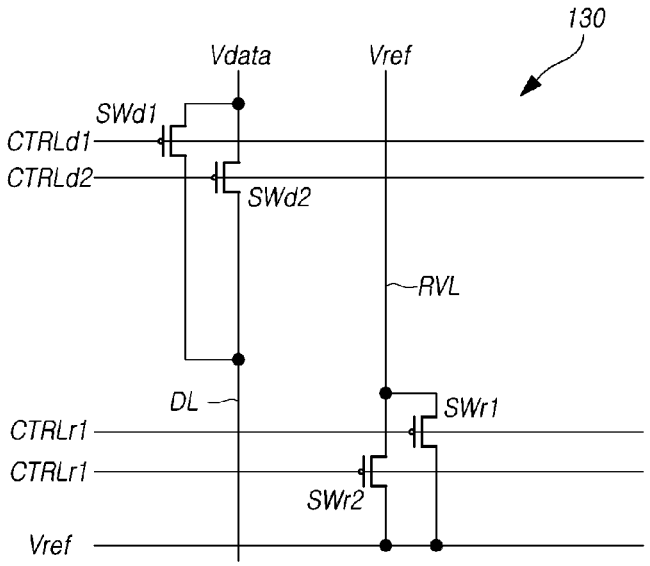
FIG. 12 illustrates a partial configuration of a data driving circuit for controlling a timing of a reference voltage supplied to a reference voltage line in a display device according to embodiments of the present disclosure.

FIG. 12 illustrates a partial configuration of a data driving circuit for controlling a timing of a reference voltage supplied to a reference voltage line in a display device according to embodiments of the present disclosure.

Referring to FIG. 12, the display device 100 according to embodiments of the present disclosure may include at least one data voltage switch SWd1, SWd2 disposed on the data line DL extending to the display panel 110 in order to control a time when the data voltage Vdata is supplied to the display panel 110 and a time when the data voltage Vdata is cut off.

At this time, a data voltage switch may be disposed on a data line DL, but two or more data voltage switches SWd1, SWd2 may be disposed on a data line DL in consideration of defects such as disconnection or active control. Here, it illustrates a case that two data voltage switches SWd1, SWd2 are disposed on a data line DL as an example.

Meanwhile, the on-off of at least one data voltage switch SWd1, SWd2 disposed on a data line DL is controlled by each of control signals-for-data voltage switches CTRLd1, CTRLd2. For example, the data voltage Vdata being supplied to the display panel 110 is cut off when both data voltage switches SWd1, SWd2 are turned off, but the data voltage Vdata is supplied to the display panel 110 when one or more among the two data voltage switches SWd1, SWd2 is turned on.

In addition, at least one reference voltage switch SWr1, SWr2 may be disposed on the reference voltage line RVL extending to the display panel 110 in order to control a time when the reference voltage Vref is supplied and a time when the reference voltage Vref is cut off.

At this time, a reference voltage switch may be disposed on a reference voltage line RVL, but two or more reference voltage switches SWr1, SWr2 may be disposed on a reference voltage line RVL in consideration of defects such as disconnection or active control. Here, it illustrates a case that two reference voltage switches SWr1, SWr2 are disposed on a reference voltage line RVL as an example.

Meanwhile, the on-off of at least one reference voltage switch SWr1, SWr2 disposed on a reference voltage line RVL is controlled by each of switch control signals CTRLr1, CTRLr2. For example, the reference voltage Vref being supplied to the display panel 110 is cut off when both reference voltage switches SWr1, SWr2 are turned off, but the reference voltage Vref is supplied to the display panel 110 when one or more among the two reference voltage switches SWr1, SWr2 is turned on.

Accordingly, the display device 100 of the present disclosure may control the timing of the reference voltage Vref supplied to the reference voltage line RVL in accordance with the timing of the scan signal SCAN supplied to the gate line GL by controlling the on-off timing of the reference voltage switches SWr1, SWr2 disposed on the data driving circuit 130.

Figure 13:
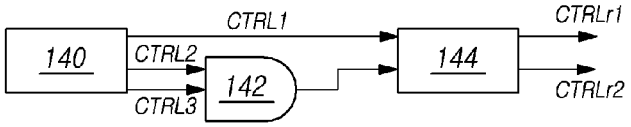
FIG. 13 illustrates a structure for generating a control signal of a reference voltage switch in a display device according to embodiments of the present disclosure.

FIG. 13 illustrates a structure for generating a control signal of a reference voltage switch in a display device according to embodiments of the present disclosure.

Referring to FIG. 13, the display device 100 according to embodiments of the present disclosure may generate control signals-for-reference voltage switches CTRLr1, CTRLr2 by the timing controller 140 in order to control the reference voltage switches SWr1, SWr2 connected to the reference voltage line RVL.

The timing controller 140 may supply first to third control signals CTRL1, CTRL2, CTRL3 in order to generate the control signals-for-reference voltage switches CTRLr1, CTRLr2. The first control signal CTRL1 is a signal for generating a first control signal-for-reference voltage switch CTRLr1 that controls the first reference voltage switch SWr1 connected to the reference voltage line RVL, and the second control signal CTRL2 is a signal for generating a second control signal-for-reference voltage switch CTRLr2 that controls the second reference voltage switch SWr2 connected to the same reference voltage line RVL.

At this time, the reference voltage Vref of the reference voltage line RVL is cut off only when the first reference voltage switch SWr1 and the second reference voltage switch SWr2 are turned off at the same time, since the first reference voltage switch SWr1 and the second reference voltage switch SWr2 are connected in parallel to the same reference voltage line RVL.

The third control signal CTRL3 is a signal for controlling start time at high level of the second control signal-for-reference voltage switch CTRLr2 generated by the second control signal CTRL2.

The second control signal CTRL2 and the third control signal CTRL3 are supplied to the logic circuit 142, and an output signal is generated by the logic circuit 142. When the logic circuit 142 is an AND gate, the output signal of the logic circuit 142 is generated at a high level only when both the second control signal CTRL2 and the third control signal CTRL3 are at a high level. Accordingly, the timing controller 140 may control the time at which the second control signal-for-reference voltage switch CTRLr2 changes to the high level by controlling the time at which the third control signal CTRL3 is supplied.

A level shifter 144 receives the first control signal CTRL1 and the output signal of the logic circuit 142. Accordingly, the first control signal-for-reference voltage switch CTRLr1 and the second control signal-for-reference voltage switch CTRLr2 changed to levels for control of the first reference voltage switch SWr1 and the second reference voltage switch SWr2 may be generated.

In this case, the level shifter 144 may be omitted in generating the first control signal-for-reference voltage switch CTRLr1 and the second control signal-for-reference voltage switch CTRLr2.

Figure 14:
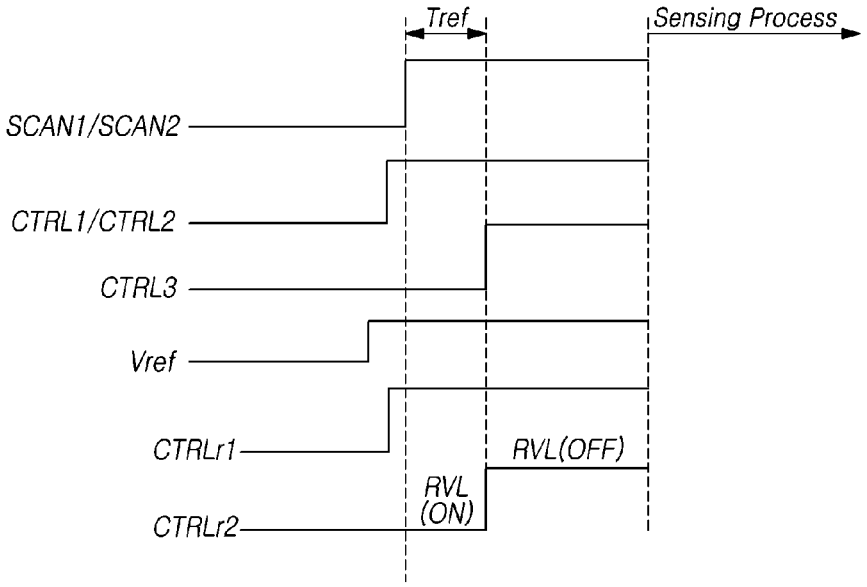
FIG. 14 illustrates a signal timing diagram for reducing a light emission error of a subpixel in a display device according to embodiments of the present disclosure.

FIG. 14 illustrates a signal timing diagram for reducing a light emission error of a subpixel in a display device according to embodiments of the present disclosure;

Referring to FIG. 14, the display device 100 according to embodiments of the present disclosure may reduce a light emission error appearing at the start of the sensing process by keeping the light emitting diode EL in a stable turn-off state before the sensing process for sensing the characteristic value of the driving transistor DRT disposed in the subpixel SP.

Here, it illustrates a case that the p-type transistors are turned on by low-level signals in the subpixel SP made of a p-type transistors as shown in FIG. 10.

In the display device 100 of the present disclosure, the reference voltage Vref of the level for turning off the light emitting diode EL is supplied through the reference voltage line RVL in a state that the first scan transistor T1, which controls the on-off time of the driving transistor DRT by the first scan signal SCAN1, and the second scan transistor T2, which controls the sensing time of the anode electrode of the light emitting diode EL by the second scan signal SCAN2, are turned off.

Here, the first scan transistor T1, which controls the on-off time of the driving transistor DRT by the first scan signal SCAN1, and the second scan transistor T2, which controls the sensing time of the anode electrode of the light emitting diode EL by the second scan signal SCAN2, correspond to scan transistors.

As described above, the first control signal CTRL1 is a signal for generating a first control signal-for-reference voltage switch CTRLr1 that controls the first reference voltage switch SWr1 connected to the reference voltage line RVL, and the second control signal CTRL2 is a signal for generating a second control signal-for-reference voltage switch CTRLr2 that controls the second reference voltage switch SWr2 connected to the same reference voltage line RVL.

The third control signal CTRL3 is a signal for controlling start time at high level of the second control signal-for-reference voltage switch CTRLr2 generated by the second control signal CTRL2.

The reference voltage Vref of the reference voltage line RVL is cut off only when the first reference voltage switch SWr1 and the second reference voltage switch SWr2 are turned off at the same time, since the first reference voltage switch SWr1 and the second reference voltage switch SWr2 are connected in parallel to the same reference voltage line RVL.

Accordingly, the first control signal-for-reference voltage switch CTRLr1 is supplied at a high level or a low level according to a level variation of the first control signal CTRL.

In addition, the second control signal-for-reference voltage switch CTRLr2 with a high level is generated at the time when both the second control signal CTRL2 and the third control signal CTRL3 are supplied at high level by the logic circuit 142 to which the second control signal CTRL2 and the third control signal CTRL3 are supplied.

Accordingly, the first reference voltage switch SWr1 connected to a reference voltage line RVL is turned off when the first control signal-for-reference voltage switch CTRLr1 is supplied at a high level. However, the switch SWr2 connected to same reference voltage line RVL is turned off when both the second control signal CTRL2 and the third control signal CTRL3 are supplied at high level.

Therefore, a time at which the reference voltage line RVL is turned off may be determined by controlling a time at which the timing controller 140 generates the third control signal CTRL3 at a high level.

Accordingly, when the timing controller 140 generates the third control signal CTRL3 with a high level later than the first control signal CTRL1 and the second control signal CTRL2 by a predetermined time, the time at which the reference voltage line RVL is turned off may be delayed by delaying the time at which the second control signal-for-reference voltage switch CTRLr2 is changed to a high level.

As described above, the reference voltage line RVL may be maintained in a turn-on state for a predetermined time even if the scan transistors T1, T2 are turned off by the scan signals SCAN1, SCAN2. It is possible to reduce a light emission error that occurs while the reference voltage line RVL is floating by supplying the reference voltage Vref at a level for turning off the light emitting diode EL in this state.

Figure 15:
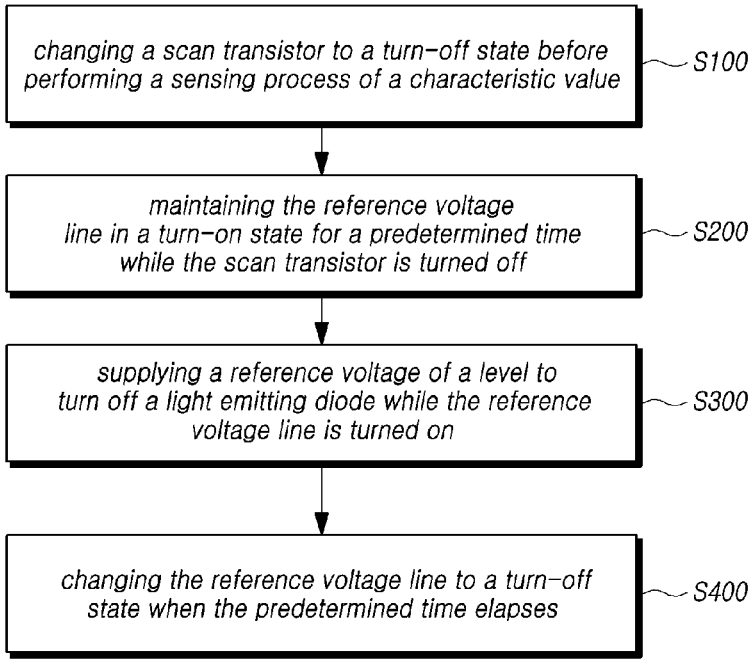
FIG. 15 illustrates a flowchart of a driving method of a display device according to embodiments of the present disclosure.

FIG. 15 illustrates a flowchart of a driving method of a display device according to embodiments of the present disclosure.

Referring to FIG. 15, a driving method of the display device 100 according to embodiments of the present disclosure may include a step of changing a scan transistor to a turn-off state before performing a sensing process of a characteristic value S100, a step of maintaining the reference voltage line RVL in a turn-on state for a predetermined time while the scan transistor is turned off S200, a step of supplying a reference voltage Vref of a level to turn off a light emitting diode EL while the reference voltage line RVL is turned on S300, and a step of changing the reference voltage line RVL to a turn-off state when the predetermined time elapses S400.

The step of changing the scan transistor to the turn-off state before performing the sensing process of a characteristic value S100 is a process of changing at least one scan transistor to which the scan signal SCAN or the emission signal EM is supplied through the gate line GL into a turn-off state for controlling a time of operating the driving transistor DRT or a time of sensing the voltage of the anode electrode of the light emitting diode EL.

The step of maintaining the reference voltage line RVL in a turn-on state for a predetermined time while the scan transistor is turned off S200 is a process of maintaining the turn-on state of the reference voltage line RVL by blocking a floating state of the reference voltage line RVL while the scan transistor is turned off, and by turning on at least one of reference voltage switches SWr1, SWr2 connected to the reference voltage line RVL to supply the reference voltage Vref of a certain level.

The step of supplying a reference voltage Vref of a level to turn off a light emitting diode EL while the reference voltage line RVL is turned on S300 is a process of supplying the reference voltage Vref of the level to turn off the light emitting diode EL while the reference voltage line RVL is turned on and maintaining a turn-off state of the light emitting diode EL by turning on at least one of reference voltage switches SWr1, SWr2.

Accordingly, it is possible to reduce the voltage increase due to a coupling and a light emission error of the light emitting diode EL since the light emitting diode EL maintains the turn-off state while the scan transistor is turned off before the sensing process of the characteristic value is performed.

The step of changing the reference voltage line RVL to a turn-off state when the predetermined time elapses S400 is a process of turning off the reference voltage line RVL for sensing a characteristic value of the driving transistor DRT.

As described above, the display device 100 of the present disclosure may reduce the light emission error by maintaining the reference voltage Vref of the reference voltage line RVL at the level of turning off the light emitting diode EL while the scan transistors are turned off before the sensing process for sensing the characteristic value of the driving transistor DRT is performed.

The above description and the accompanying drawings provide an example of the technical idea of the present disclosure for illustrative purposes only. Those having ordinary knowledge in the technical field, to which the present disclosure pertains, will appreciate that various modifications and changes in form, such as combination, separation, substitution, and change of a configuration, are possible without departing from the essential features of the present disclosure. Therefore, the embodiments disclosed in the present disclosure are intended to illustrate the scope of the technical idea of the present disclosure, and the scope of the present disclosure is not limited by the embodiment. The scope of the present disclosure shall be construed on the basis of the accompanying claims in such a manner that all of the technical ideas included within the scope equivalent to the claims belong to the present disclosure.

What is claimed is:

1. A display device comprising:

a display panel on which a plurality of gate lines, a plurality of data lines, a plurality of reference voltage lines, and a plurality of subpixels are disposed;

a gate driving circuit configured to provide scan signals to the plurality of gate lines;

a data driving circuit configured to provide data voltages to the plurality of data lines, the data driving circuit including at least one reference voltage switch configured to control reference voltages supplied to the plurality of reference voltage lines; and a timing controller configured to control the gate driving circuit and the data driving circuit, and maintain a reference voltage of a reference voltage line from the plurality of reference voltage lines at a level of turning off a light emitting element before a sensing process for sensing a characteristic value of the plurality of subpixels is performed, wherein the reference voltage having the level of turning off the light emitting element is maintained from a first time when a first scan transistor and a second scan transistor, which are disposed on the plurality of subpixels, are turned off to a second time when the reference voltage line is turned off.

2. The display device according to claim 1, wherein at least one of the plurality of subpixels include:

a driving transistor configured to provide current to the light emitting element;

a storage capacitor electrically connected between a gate node and a source node or a drain node of the first scan transistor, wherein the first scan transistor is electrically connected between a gate node of the driving transistor and a data line from the plurality of data lines;

wherein the second scan transistor is electrically connected between a source node or a drain node of the driving transistor and the reference voltage line.

3. The display device according to claim 1, wherein at least one of the plurality of subpixels include:

a driving transistor configured to provide current to the light emitting element;

a third scan transistor in which a gate node is connected to a light emitting line, a drain node is connected to a driving voltage line, and a source node is connected to a drain node of the driving transistor;

a storage capacitor connected between a gate node and a source node of the driving transistor; and an auxiliary capacitor connected between the driving voltage line and the source node of the driving transistor, wherein the first scan transistor in which a gate node is connected to a first gate line from the plurality of gate lines, a drain node is connected to a data line from the plurality of data lines, and a source node is connected to a gate node of the driving transistor;

wherein the second scan transistor in which a gate node is connected to a second gate line from the plurality of gate lines, a drain node is connected to the reference voltage line, and a source node is connected to a source node of the driving transistor.

4. The display device according to claim 1, wherein at least one of the plurality of subpixels include:

a driving transistor configured to provide current to the light emitting element;

a third scan transistor connecting a gate node and a source node of the driving transistor in response to the first scan signal;

a fourth scan transistor suppling the reference voltage to a first node to which the first scan transistor and a storage capacitor are connected in response to a light emission control signal;

a fifth scan transistor controlling a driving current flowing to an anode electrode of the light emitting element in response to the light emission control signal;

the storage capacitor connected between the driving transistor and the first scan transistor; and an auxiliary capacitor connected between the driving voltage line and the anode electrode of the light emitting element, wherein the first scan transistor transmits a data voltage supplied through a data line from the plurality of data lines in response to a first scan signal;

wherein the second scan transistor supplies the reference voltage to an anode electrode of the light emitting element in response to a second scan signal.

5. The display device according to claim 1, wherein at least one of the plurality of subpixels include:

a third scan transistor connected between a driving voltage line and a source node of the driving transistor;

a fourth scan transistor connected between a drain node of the driving transistor and an anode electrode of the light emitting element;

a fifth scan transistor connected between a gate node of the driving transistor and the reference voltage line;

a sixth scan transistor connected between the reference voltage line and the anode electrode of the light emitting element; and a storage capacitor connected between the driving voltage line and the fifth scan transistor, wherein the first scan transistor is connected between a gate node and a drain node of the driving transistor;

wherein the second scan transistor is connected between a data line from the plurality of data lines and a source node of the driving transistor.

6. The display device according to claim 1, wherein the data driving circuit includes:

a first reference voltage switch connected to one reference voltage line of the plurality of reference voltage lines; and a second reference voltage switch connected in parallel with the first reference voltage switch through the one reference voltage line.

7. The display device according to claim 6, further comprising:

a logic circuit configured to receive a second control signal and a third control signal from the timing controller; and a level shifter configured to receive a first control signal from the timing controller and an output signal of the logic circuit, and generate a first control signal-for-reference voltage switch and a second control signal-for-reference voltage switch for controlling the first reference voltage switch and the second reference voltage switch.

8. The display device according to claim 1, wherein the characteristic value of the plurality of subpixels is a threshold voltage or a mobility of the driving transistor.

9. The display device according to claim 1, wherein the sensing process includes at least one of:

an on-sensing process in which the characteristic value is sensed during a parameter loading process after a power-on signal is generated;

an off-sensing process in which the characteristic value is sensed while the data voltage is cut off after a power-off signal is generated; and a real-time sensing process in which the characteristic value is sensed for each blank period during a display driving period.

10. A driving method of a display device including a display panel on which a plurality of gate lines, a plurality of data lines, a plurality of reference voltage lines, and a plurality of subpixels are disposed, a gate driving circuit configured to provide scan signals to the plurality of gate lines, and a data driving circuit configured to provide data voltages to the plurality of data lines, the data driving circuit including at least one reference voltage switch for controlling reference voltages supplied to the plurality of reference voltage lines, comprising:

changing a scan transistor to a turn-off state before performing a sensing process of a characteristic value of the plurality of subpixels;

maintaining a reference voltage line from the plurality of reference voltage lines in a turn-on state for a predetermined time while the scan transistor is turned off;

supplying a reference voltage of a level to turn off a light emitting element while the reference voltage line is turned on; and changing the reference voltage line to a turn-off state when the predetermined time elapses.

11. The driving method of the display device according to claim 10, further comprising:

receiving, by a logic circuit of the data driving circuit, a second control signal and a third control signal from a timing controller; and receiving by a level shifter of the data driving circuit, a first control signal and an output signal of the logic circuit to which a second control signal and a third control signal are supplied, and generating a first control signal-for-reference voltage switch and a second control signal-for-reference voltage switch for controlling a first reference voltage switch and a second reference voltage switch, wherein a first reference voltage switch is connected to one reference voltage line of the plurality of reference voltage lines, and a second reference voltage switch connected in parallel with the first reference voltage switch through the one reference voltage line.

12. The driving method of the display device according to claim 10, wherein the sensing process includes at least one of:

an on-sensing process in which the characteristic value is sensed during a parameter loading process after a power-on signal is generated;

an off-sensing process in which the characteristic value is sensed while the data voltage is cut off after a power-off signal is generated; and a real-time sensing process in which the characteristic value is sensed for each blank period during a display driving period.

* * * * *